US007907063B2

(12) United States Patent
Simon

(10) Patent No.: US 7,907,063 B2
(45) Date of Patent: Mar. 15, 2011

(54) SPEED LIMIT ENFORCER

(76) Inventor: Kenneth Lenard Simon, Sumter, SC (US)

( * ) Notice: Subject to any disclaimer, the term of this patent is extended or adjusted under 35 U.S.C. 154(b) by 222 days.

(21) Appl. No.: 12/214,848

(22) Filed: Jun. 23, 2008

(65) Prior Publication Data

US 2009/0243883 A1 Oct. 1, 2009

Related U.S. Application Data

(60) Provisional application No. 61/070,915, filed on Mar. 26, 2008.

(51) Int. Cl.
*G08G 1/09* (2006.01)

(52) U.S. Cl. ..... 340/905

(58) Field of Classification Search ..... 340/905, 340/441, 466, 936, 438, 539.1; 701/70, 117, 701/119

See application file for complete search history.

(56) References Cited

U.S. PATENT DOCUMENTS

| | | | | |
|---|---|---|---|---|
| 4,591,823 | A * | 5/1986 | Horvat | 340/936 |
| 6,166,658 | A * | 12/2000 | Testa | 701/93 |
| 6,388,578 | B1 * | 5/2002 | Fagan et al. | 340/901 |
| 6,864,784 | B1 * | 3/2005 | Loeb | 340/441 |
| 7,660,658 | B2 * | 2/2010 | Sheynblat | 701/93 |

* cited by examiner

*Primary Examiner* — Phung Nguyen
(74) *Attorney, Agent, or Firm* — B. Craig Killough

(57) ABSTRACT

A device and method for providing speed limit and other roadway and traffic information to a vehicle. A signal is transmitted from a remote source, such as a satellite, to one or more ground transmitters. The ground transmitters are located apart from each other and adjacent to various sections of roadway, which may include work zones, school zones, residential areas, truck routes, interstate corridors, and highways, or in other vehicles, such as law enforcement and emergency vehicles. The ground transmitters have the necessary hardware and software for receiving and transmitting speed limit and other roadway information. The receiving device has the necessary hardware and software to receive speed limit and other information, and may translate speed information to vehicle components, such as an engine control computer for fuel and/or speed control. The receiver may use various signals audibly and visually to insure a higher level of driver awareness.

20 Claims, 2 Drawing Sheets

SPEED LIMIT ENFORCER

CROSS-REFERENCE TO RELATED APPLICATION

This application claims benefit of U.S. Provisional Application Ser. No. 61/070,915 filed Mar. 26, 2008

BACKGROUND OF THE INVENTION

The unique functions of this invention will help change the way we drive in America today. This invention will assist Commercial Drivers by relaying and confirming speed limit information vital to highway safety. This invention will help to keep drivers aware of their surroundings at all times, reduce all types of accidents and collisions due to illegal high speeds, reduce carbon emissions into the air/atmosphere, lower fuel consumption and could save lives.

While traveling on the highway quit often this ideal came about in an effort to notify Commercial Drivers of what the speed limit is in the zone approached or currently traveling in. This invention will let drivers know what type of zone they approaching are driving in, and also let drivers know what the truck speed limit is as well if different than car speed limit. The Speed Limit Enforcer would primarily be used in Commercial or Military vehicles and will reduce fuel consumption. The Speed Limit Enforcer can also be implemented in gasoline driven vehicles as well.

DESCRIPTION OF PREFERRED EMBODIMENTS

Figure 1:
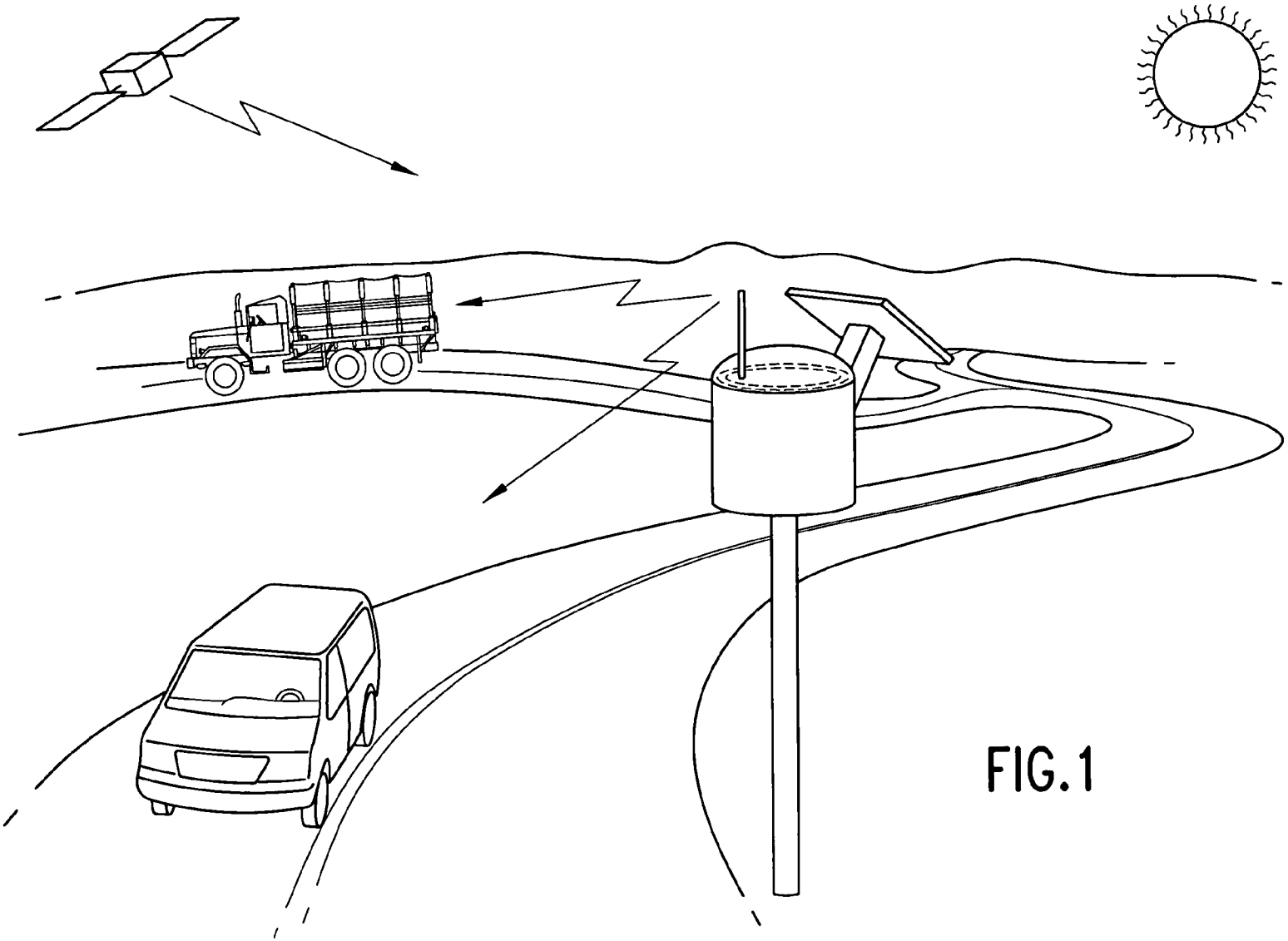
FIG. 1 illustrates an embodiment of the speed limit enforcer in a location along a section of roadway and in use.
Figure 2:
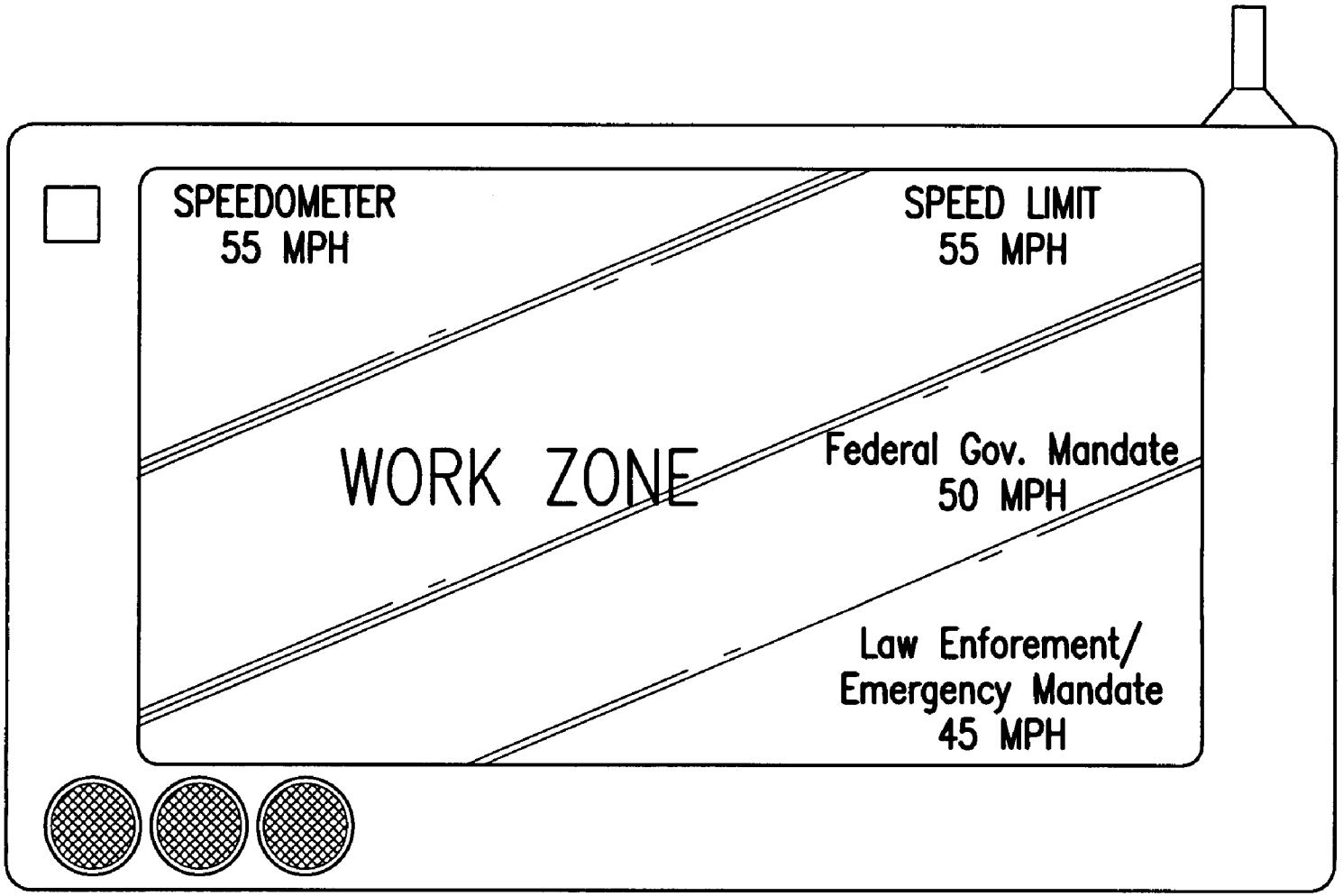
FIG. 2 is an elevation of a receiving device or receiver that may be located in a vehicle.

The unique functions of this invention are described as followed. The Speed Limit Enforcer is made up of and made functional by several parts which include vehicle receiving devices, satellites with satellite transmitters and ground transmitters. The Speed Limit Enforcer's Ground Transmitters would be powered by electricity, battery, or electricity/battery combination, solar energy, or battery/solar energy combination. Ground Transmitters would be constructed of water and weather proof materials made of plastic and metal products. Ground Transmitters would also include insulation to protect various components, software, hardware, rubber coated electrical wires, internal and external wireless type antennas capable of sending data to the Speed Limit Enforcer's Receiving Device located inside the Commercial Vehicle. Ground Transmitters will also be capable of receiving information and updates via satellite systems when necessary. Ground Transmitter would primarily work independent of satellite in the process of transmitting speed limit and zone information to Speed Limit Enforcer's Receiving Device.

Ground Transmitters could also work in conjunction with satellites to insure accuracy. When necessary, the Speed Limit Enforcer's Receiving Device will utilize a mode called Automatic Satellite Mode, which automatically switches to satellite transmitting if Speed Limit Enforcer's Receiving Device detects a defected or malfunctioning Ground Transmitter that is temporarily unable to transmit speed or zone information. If Satellite and Ground Transmitters both malfunction simultaneously the Speed Limit Enforcer's Receiving Devise will go into Speed Limit Awareness Mode displayed in zone information section of screen as SPEED LIMIT AWARENESS not flashing, constantly reminding driver verbatim and prompting driver every 7 minutes audibly to be cognizant of posted speed limit signs and zones etc., at all times. Speed Limit Awareness Mode will remain on until receiver picks up a signal via Ground Transmitter or Satellite Transmitter. The Speed Limit Enforcer's Receiving Device would also be made of durable plastic, durable metal, rubber coated electrical wires, hardware and software, with a monitor screen capable of displaying and relaying information in several languages, and also touch screen capable for retrieving stored information, manual information input and software updating. Speed Limit Enforcer's Receiving Device also has software capable of transmitting as well. Receiving Device would also have speakers to relay information audibly along with volume control for clarity. Receiving Device would also have external outlets and ports such as electrical, DC, land line phone and computer ports. Receiving Devise would also have wireless internal and external type antennas for increased reception, hardware and software capable of translating received speed limit and zone information from the Ground Transmitters, and hardware and software capable of transmitting speed limit information to engine computer via wire or wireless connection. Speed Limit Enforcer's Receiving Device would be placed on the windshield, dash, or built into dash of vehicle visible to driver but not to obstruct safety or view of highway. The Speed Limit Enforcer's Ground Transmitters would be placed in or on top of speed limit signs, throughout all truck route corridors, suggested speed limit signs, light poles, separate poles, residential areas, school zones, work zones, etc. Ground Transmitters would be placed in or on Federal, State and Local Government authorized work vehicles as while as Law Enforcement and Emergency Vehicles. Ground Transmitters would also be placed in areas of intersections, curves, sharp curves and steep downward grades warning the driver of the speed limit or suggested safe speed limit for that intersection, curve, sharp curves or steep downward grades, and prompting and warning driver audibly if intersection, steep downward grade, curve or sharp curves have a high accident or roll over rate for Commercial Vehicles. Ground Transmitters on or in these areas or transmitters via satellite would send a signal to the Speed Limit Enforcer's Receiving Device activating it's software letting the driver know what type of zone they are approaching or traveling in such as school zones, work zones, residential areas, etc. Specified name of zone will only appear and be displayed on receiver monitor screen when actually in that zone (WORK ZONE 55 MPH). Only work, school and residential zone areas, and non specified zones would be displayed in yellow script not flashing. All non specified zone information will be display on the monitor screen in yellow not flashing as (NON SPECIFIED ZONE) first. Then after 40 seconds screen will display (STAY ALERT) in bright yellow not flashing. STAY ALERT will be displayed on screen in replacement of work, school, and residential prompts when traveling in zone that has not been specified. Displayed letters and numbers on monitor screens can be set to display in bold script, or letters in lower or upper case with the option to dim or brighten letters and numbers for visual comfort. Speed Limit Enforcer's Receiving Device will also prompt Commercial Driver letting him/her know what the posted speed limit will be within 500 feet of next Ground Transmitter/speed zone border, or what the speed limit is in their current travel zone, and whether or not to maintain current speed or reduce speed in accordance with the current zone and applicable speed limit laws for that area, or upcoming zone that has changed to a lower speed limit. The Speed Limit Enforcer's Receiving Device will also have a built in speedometer that calculates exact speed of Commercial Vehicle when traveling. When traveling through intersections, residential areas, school zones, around sharp curves recommending lower speeds, and downward slopes and hills, and throughout all corridors, the Speed Limit Enforcer's Receiving Device will prompt driver audibly, verbatim on screen, and display actual speed of commercial vehicle on receiver's monitor screen along with flashing speedometer readings/numbers in bright yellow flashing once every second in comparison to posted speed limit readings/numbers in green not flashing, displayed on receiver screen. Speedometer reading/numbers will only flash in bright yellows one flash per second within 500 feet of next Ground Transmitter/speed zone border that has changed to a lower speed limit. If posted speed limit is obtained before or simultaneously when passing Ground Transmitter or speed zone border, speedometer readings will then flash 2 times in green within ¾ of a second and then remain green not flashing as long as posted speed limit is maintained. If speed limit has not been obtained when vehicle passes speed zone border or Ground Transmitter, the Speed Limit Enforcer's Receiving Device will prompt driver audibly with 2 consecutive beeps within ½ second and also prompt driver verbatim via receiver's monitor screen and speakers audibly informing driver of current speed limit violation, the type of zone they are in, and to reduce speed of vehicle to comply with posted speed limit for that zone or area. Speedometer readings/numbers will flash in bright red one flash per second continuously until posted speed limit is obtained and maintained. The 2 beeps within ½ second prompt will continue to prompt driver every 12 seconds with 2 beeps within ½ second until speedometer matches posted speed limit. Speedometer readings/numbers flashing in red flashing one flash per second and the 2 beeps within ½ second prompting every 12 seconds will begin simultaneous when speedometer and posted speed limit readings does not match on the receiver monitor screen along with audible and displayed prompts warning and notifying driver to obey posted speed limit. Readings/numbers will continue to flash in bright red until posted speed limit or suggest speed limit is obtained and maintained. When posted speed limit is obtained, speedometer readings will flash two times in green within ¾ of a second and then remain green without flashing to match with posted speed limit readings in bright green not/never flashing on receiver screen. The 2 beeps within ½ second prompt repeated every 12 seconds will prompt driver via receiver when vehicle approaches Ground Transmitter/speed zone border, within 500 feet, at a higher speed limit then what is posted for the upcoming speed zone, or driving in a zone at a higher speed than what is posted. If Commercial Vehicle is traveling at a speed equal to less than what is post for the upcoming speed zone within 500 feet, speedometer readings/numbers will remain green not flashing and Receiving Device will display speed limit and zone information accordingly. Receiving Device will let driver know approximately 500 feet ahead of next Ground Transmitter or speed zone border of what the next speed limit will be, whether the speed limit has change or remains the same. Electronic Sensors inside the Ground or Satellite Transmitters will be capable of communicating with the software and hardware of the Speed Limit Enforcer's Receiving Device for distant measurement between Vehicle Receiving Device and Ground Transmitter/speed zone border which will enable this function. The Speed Limit Enforcer's Ground Transmitters will be able to measure width for accuracy in transmitting speed limit and zone information to on coming traffic and will primarily send speed limit information to oncoming traffic approaching transmitter in the right lane with the capability of sending information to receiver when vehicle has passed. Receding traffic in the right lane will continue to receive speed limit and zone information up to 1000 feet pass Ground Transmitter or zone border when needed. Ground Transmitters will be able to determine when a vehicle receiving device has passed a speed limit border or Ground Transmitter when entering a new speed zone. However transmitted information will be stored in receiver's hardware for the utilization of all features and functions when initially received via Ground or Satellite Transmitter. The Speed Limit Enforcer's Ground Transmitters will only be able to sent data to Vehicle Receiving Devices in receding traffic in all directions and opposite side of highway when speed limit is altered thru a Government or Law Enforcement/Emergency Personnel Mandate executed the Federal, State, or Local Government, or if Receiving Device did not receive signal 500 ahead or at Ground Transmitter or zone border. Speed limit and zone information sent to vehicle receivers from Ground or Satellite Transmitters will be stored temporarily according to memory space in the Speed Limit Enforcer's Receiving Device's hardware or software. Stored information will prompt driver and utilize all features and function ultimately to obtain and maintain a safe and legal speed according to law. Stored information can only be overridden and replace with updated information when vehicle approaches the next speed zone within 500 feet via Ground or Satellite Transmitter or Government Mandate altering speed limit. Speed Limit Enforcer's Ground Transmitters in work zones, school zones, residential areas, truck routes, and normal speed zones would be set or programmed manually, via satellite or wireless service as to what the speed limit will be for that speed zone or corridor area based on applicable speed limit laws for that area or zone. Over 100 billion codes would be stored in Ground Transmitters, Satellite Transmitters and Vehicle Receiver's data base for manual updating purposes, updates submitted via satellite or wireless service, and also transmitting purposes which will insure accuracy of speed limit and zone information transmitted to receiver from transmitter(s). Codes would also be used for transmitting speed limit information from Speed Limit Enforcer's Receiving Device to engines computer which would insure accuracy in the transmitting of speed limit information from receiver to engines computer. Receiving Device would have a primary I.D. code that matches one of the billions of codes downloaded into Ground or Satellite Transmitters for device identification purposes to further insure accuracy in the operation of this invention. Additional features would also insure speed control in Commercial Vehicles. The Speed Limit Receiving Device will also have and utilize the built in speedometer that's capable of detecting the actual traveling speed of the Commercial Vehicle for comparison with posted speed limit for driver awareness. The Speed Limit Enforcer's Ground Transmitter would send speed limit information to the Speed Limit Enforcer's Receiving Device located inside the Commercial or Military Vehicle which would notify the driver of the up coming speed zone within 500 feet that has changed to a lower speed limit. The Speed Limit Enforcer's Receiving Device would initially and simultaneously prompt the driver with two consecutive beeps within ½ second audibly every 12 seconds along with speedometer readings/numbers (showing a higher travel speed then what's posted) flashing continuously in bright yellow one flash per second, and current legal speed limit numbers in green, not flashing, on receiver screen for comparison. Legal Speed Limit information would simultaneously be transmitted to the Commercial Vehicle's engine computer from the Speed Limit Enforcer's Receiving Device via wire or wireless connection to the engine's computer to began restricting fuel to the fuel injectors down to or between 1300 and 600 RPM or manufactures lowest RPM idle speed of engine, in an effort to slow the Commercial or Military vehicle down to the legal speed limit for that area or zone within 500 feet of upcoming zone, and will continue to restrict fuel until vehicle is traveling at the legal speed for zone entered. Speedometer readings/numbers will continue to flash in bright yellow one flash per second within 500 feet of speed zone border or Ground Transmitter until posted speed limit has been obtained. If posted speed limit has not been obtained by the time vehicle passes Ground Transmitter/speed zone border, speedometer readings/numbers will then be displayed in bright red simultaneously with 2 beeps within ½ second every 12 seconds, and will display in zone information section of screen in bright red not flashing, if speed limit violation occurs 12 or more time consecutively at any time, as (12 SPEED LIMIT VIOLATIONS); this is called 12 Point Speed Limit Violation Mode. Receiving Device will have a violation counter the counts speed limit violation up to 12 violation. Violations will be store in Receiving Device for a period of time specified by owner. Violations would be defined as obtaining legal speed and then exceeding legal speed via steep downward slopes or hills (Over The Speed Limit Prompts), or when legal speed limit was never obtained when vehicle passed Ground Transmitter or zone border entering new zone at a higher speed than what is posted (SPEED LIMIT VIOLATION). When 12 over the speed limit violations have occurred, Receiving Device will govern Commercial Vehicle's Engine not to exceed a max speed of 55 MPH for two hours travel time along with fuel restrictions at lower speed limits for speed limit enforcement. After two hours have passed, Receiving Device will cancel 55 MPH temporary governor, reset 12 Point Speed Limit Violation Mode counting next violation as violation number one, and allow vehicle to travel at higher speed limits when legal. Twelve Point Speed Limit Violation Mode will not interfere with any preset governor programmed into engine computer setting vehicle to an over all max vehicle speed pre determined by Trucking Company or owner of vehicle. Speedometer numbers will continue to flash in red once every second, and receiving device will continue to prompt driver with 2 beeps within ½ second every 12 seconds until legal speed is obtained in any mode. When legal speed limit is obtained, speedometer reading/numbers will simultaneously turn to green and flash 2 times in green within ¾ of a second and then remains green not flashing to match with the already posted speed limit numbers that are green not flashing. Zone information, UNSPECIFIED ZONE, or STAY ALERT would then be displayed in bright yellow not flashing when vehicle is traveling at legal speed limit. Posted speed limit readings/numbers on receiver screen will always remain green not flashing at all times in any mode. Speed Limit Enforcer's Receiving Device will not allow the Commercial Vehicle to exceed speed limit via fuel restriction until Commercial Vehicle enters a higher speed zone that allows Commercial Vehicles to travel at higher speed limits. Fuel will gradually become unrestricted so that engine's RPM can be increased as needed to ensure appropriate balance of RPM to match with enforced speed of Commercial Vehicle in and effort to maintain legal speed without lugging engine. This feature will also allow driver to engage or disengage service brakes, engine brakes, and down shift as needed at any time to assist in slowing Commercial Vehicle down to legal speed limit. The Speed Limit Enforcer's Ground Transmitter will also prompt driver via Vehicle Receiver in the current speed zone after vehicle has passed the Ground Transmitter/speed zone border up to 1000 as needed to insure receiver received updated speed limit and zone information, and has stored that information in receive data base or hardware. Prompts will continue as needed by Vehicle Receiving Device after passing zone border via stored information in Vehicle's Receiving Device prompting driver every 12 seconds with 2 beeps within ½ second if Commercial Vehicle has not slowed down to legal speed limit. Prompts will also continue audibly and verbatim via screen and speaker warning driver of current speed limit violations as long as violations continue. The receiver screen will continue to display updated speed limit and zone information along with exact speed that Commercial Vehicle is traveling. Speedometer reading/numbers displaying exact speed will continue to flash in bright red once per second until speed of vehicle matches legal posted speed limit displayed on receiver's monitor screen. Speedometer numbers displaying exact speed would flash 2 times within ¾ of a second in green and then remain green not flashing when speed of vehicle matches legal speed limit on monitor screen. Speed Limit Enforcer's Receiving Device will also have a Interchangeable Light that switches from green to red, then back to green when legal, or yellow within 500 feet only of new speed zone with lower speed limits being approached, located in the far upper left corner of device visible to driver as an additional alert signal in conjunction with posted speed limit numbers on monitor, and speedometer readings and colors. The Interchangeable Light alert will always display and match with the exact colors and flashing of speedometer reading/number colors and flashing of colors, simultaneous with those readings/numbers one flash per second or 2 flashes within ¾ of a second. Speed Limit Enforcer's Receiving Device will go into a mode called Over The Speed Limit Mode and prompt driver with and Over The Speed Limit Prompt displayed verbatim on monitor screen in zone info section as OVER THE SPEED LIMIT in bright red not flashing, audibly, along with all other applicable prompts if legal speed limit was obtained and then later lost due to downward slopes or hills at anytime driver is driving over the posted speed limit along with 2 consecutive beeps within ½ second every 12 seconds with fuel being restricted accordingly. This prompt will also allow drivers to assist by down shifting or applying service or engine brakes to assist in slowing the Commercial Vehicle down to the legal speed limit during this prompt or anytime necessary. Service brakes are needed when traveling on downward slopes and hills. Over the speed limit prompts will continue until legal speed is obtained. Speed Limit Enforcer's Receiving Device also has an Engine Brake Mode that can activate engine breaks automatically as needed with fuel restrictions to assist in slowing Commercial Vehicle down to legal speed when engine brake are in the on/ready to operate position. Driver will have to turn engine break switch on. The Speed Limit Enforcer's Receiving Device Fuel Restriction Mode can be activated or deactivated at owners discretion or applicable laws while speed limit and zone information will continue to be sent to receiver in either on or off position. All other features and functions will also continue to be utilized when appropriate. Information sent to the receiver inside the Commercial Vehicle would be visible on the receiver screen, audible, or both letting the driver know in writing, audible, or both what the speed limit is for the type of vehicle they are driving (Truck Speed Limit 55 MPH). Truck speed limits will be displayed on receiver screen as (TRUCK SPEED LIMIT 55) along with car speed limit located in the far upper right corner of receiver screen above car speed limit. Truck speed limit will only be displayed on screen as TRUCK SPEED LIMIT 55 MPH with posted/car speed limit if truck speed is different than car speed limit.

When commercial vehicle enters residential, work or school zones areas, actual speed of vehicle via receiver's speedometer reading will flash in appropriate colors; yellow within 500 feet of zone with one flash per second, red at zone border or in zone over speed limit with one flash per second with 2 beeps within ½ second repeated every 12 seconds until legal speed is obtained, and green flashing 2 times within ¾ of a second then remains green without flashing when speed limit is obtained. Odometer readings located in the upper top left corner of monitor screen will flash continuously in yellow or red until speedometer readings matches posted speed limit reading located in the upper top right corner of receiver screen. When legal speed limit is obtained and maintained, speedometer reading will change to green with 2 flashes within ¾ of a second and then display without flashing in green to match the posted speed limit reading already in green on receiver screen not flashing. In gasoline driven vehicles the Speed Limit Enforcer's Receiving Device would also have a mode called Govern Speed Mode capable of being activated manually by owner via touch screen and pass word to govern automobiles at a max speed determined by the owner for young (teenage) and inexperienced drivers. While this feature is activated the Speed Limit Enforcer's Receiving Device will continue to restrict fuel when automobile approaches lower speed zones, display zones information, and all other features and functions will continue to operate effectively.

The Speed Limit Enforcer's Receiving Device is also equipped with and Unauthorized Disconnect Mode that automatically restricts fuel and sets vehicle's engine computer to govern at a max vehicle speed of 55 MPH when Speed Limit Enforcer's Receiving Device is disconnected without authorization. Speed Limit Enforcer's Receiving Device will resume normal operations when device is reconnected and password enter by authorized personnel, which will void temporary speed governor and enable legal speed limits higher than 55 MPH when legal.

(VI) This invention also include a Feature called Government Mandated Speed Modification Mode that could be implemented by the Federal, State, or Local Government when a certain area, wide spread or small, needs lower than normal speed limits due to higher than normal levels of emission that has been admitted into the air, or higher than normal accidents and fatalities due to illegal high speeds have occurred in a particular area. Government mandated speed limit information will be sent to all Ground Transmitters via satellite or wireless service in the specified area(s). Ground Transmitters and satellites would then transmit Mandated Speed information to all Vehicle Receiving Devices in all directions in that specified area. Receiving Device would then display on monitor screen (Government Mandated Speed Limit 50 MPH) with Government Mandated Speed Limit 50 MPH information flashing in red, white, and blue in rotation continuously every 3 seconds (each color flashing one second per color) until mandate is lifted. Posted speed limit numbers will always match any Government Mandated speed limit numbers not colors. Interchangeable lights will only flash in red, white and blue under Government Mandate, and will resume back to normal matching speedometer readings/number colors and flashes when mandate is lifted. Speedometer numbers will continue to flash in yellow, red, and green as appropriate during any mode or mandate. Posted speed limit numbers/readings will remain in green not flashing always, and will match any and all mandated speed limits numbers/readings only, not colors. Government Mandated Speed Limit Information would be visible on receiver's screen beneath the posted speed limit information in the center right hand corner of receiver. Fuel will be restricted accordingly as appropriate. Ground Transmitters and Receiver will resume back to normal when mandate is lifted.

(VII) Law Enforcement and Emergency personal will also be able to slow vehicles down to speeds lower than posted speed limits under the Law Enforcement/Emergency Speed Mandate Mode when appropriate via Vehicle Transmitters affixed on or in Law Enforcement and Emergency vehicles. Receiver's screen will display Law Enforcement/Emergency Speed Mandate Mode 50 MPH speed limit numbers to match posted speed limit readings/numbers (50 MPH) in green not flashing on monitor screen. Law Enforcement/Emergency Speed Mandate Mode 50 MPH displayed will flash in blue and red only per 2 seconds in rotation (one flash per color per second) simultaneously with Interchangeable Light colors flashing in blue and red one flash per color per second. Mandated information will be displayed (flashing) at bottom right corner of receiver screen until mandate is lifted. When mandate is lifted, posted speed limit numbers/readings on monitor screen will continue as normal in green, not flashing, matching legal speed limits. Posted speed limit information/readings on screen will always display in green with readings/numbers not flashing in any mode or function. Fuel will continue to be restricted in any mode as needed.

Studies by engineers has proven that fuel consumption and carbon emissions are reduced by driving at lower speeds which requires less fuel in all types of vehicle, particularly Commercial Vehicles and Commercial Vehicles hauling freight. Software in the receiving device when activated by Ground, Vehicle or Satellite Transmitters will assist in reminding drivers of the zones and speed limits in all zones when there is no speed limit signs visible or present do to road construction, weather or other various events that prevent the visibility of speed limit and zone signs or the lack there of.

This concept is vital to the American Travel System, highways and Interstate Corridors in and effort to increase Commercial Vehicle Safety on our highways, which would also decrease accidents and fatalities due to illegal high speeds in Commercial Vehicles and Commercial Vehicles hauling freight. This invention will assist drivers while traveling on our local, state and interstate highways by helping them maintaining a legal and safe speed while driving, and keep them alert and aware of their surroundings at all times. This innovative idea will ultimately improve our economy with an additional product for production, sale, and job opportunity for all Americans. This concept would also help save fuel which in return will help to maintain a cleaner environment by reducing carbon emissions into the air and make us as Americans less dependent on Foreign Oil.

The invention claimed is:

1. A method of communicating information regarding speed limits, comprising the steps of:

providing a receiver in a vehicle;

positioning a transmitter along a roadway, wherein said transmitter transmits a signal along a defined section of roadway, and wherein said defined section of roadway has a speed limit;

remotely transmitting a signal to said transmitter, wherein said signal is interpreted by said transmitter to define said speed limit for said defined section of roadway;

transmitting a signal by said transmitter to said receiver;

causing said receiver in the vehicle to receive said signal from said transmitter, wherein said signal is interpreted by said receiver and said receiver provides information to the vehicle regarding said speed limit; and subsequently transmitting a signal communicating a revised speed limit that differs from said speed limit for said defined section of roadway to said transmitter.

2. The method of communicating information regarding speed limits as set forth in claim 1, comprising the additional steps of:

providing a receiver in a second vehicle, said receiver in said second vehicle having a visual display and audio output, and causing said receiver in said second vehicle to receive said signal from said transmitter, wherein said signal is interpreted by said receiver and said receiver visually displays information regarding said revised speed limit and said receiver outputs audio information regarding said revised speed limit.

3. The method of communicating information regarding speed limits as set forth in claim 1, comprising the additional steps of:

positioning a second transmitter along a roadway, wherein said second transmitter transmits a signal along a second defined section of roadway, and wherein said second defined section of roadway has a second speed limit; and transmitting a signal to said second transmitter, wherein said signal is interpreted by said second transmitter to define said second speed limit for said second defined section of roadway to said transmitter and said receiver visually displays information regarding said second speed limit and said receiver outputs audio information regarding said second speed limit.

4. The method of communicating information regarding speed limits as set forth in claim 1, wherein said signal transmitted to said transmitter is transmitted from a satellite.

5. The method of communicating information regarding speed limits as set forth in claim 1, wherein said signal transmitted by said transmitter to said receiver is interpreted by said receiver and said receiver outputs roadway condition information for said defined section of roadway in addition to the receiver outputting the speed limit for said defined section of roadway.

6. The method of communicating information regarding speed limits as set forth in claim 1, comprising the additional steps of said receiver controlling a speed of said vehicle in response to said speed limit.

7. The method of communicating information regarding speed limits as set forth in claim 1, comprising the additional steps of said receiver controlling a speed of said vehicle in response to said speed limit by controlling a fuel flow to an engine of said vehicle.

8. The method of communicating information regarding speed limits as set forth in claim 1, comprising the additional steps of said receiver determining an approach to a speed zone of said defined section of roadway and said receiver providing a first output at a first distance from said speed zone and providing a second output at a second distance from said speed zone.

9. The method of communicating information regarding speed limits as set forth in claim 1, comprising the additional steps of said receiver determining an approach to a speed zone of said defined section of roadway and said receiver providing a first visual output at a first distance from said speed zone and providing a second visual output at a second distance from said speed zone.

10. The method of communicating information regarding speed limits as set forth in claim 1, comprising the additional steps of said receiver controlling and limiting a maximum speed of said vehicle if said vehicle exceeds said speed limit.

11. The method of communicating information regarding speed limits as set forth in claim 1, comprising the additional steps of said receiver controlling and limiting a maximum speed of said vehicle if said vehicle exceeds a plurality of speed limits as interpreted by said receiver from a plurality of signals received from a plurality of transmitters within a defined time period.

12. A method of communicating information regarding speed limits, comprising the steps of:

providing a receiver in a vehicle;

positioning a transmitter along a roadway, wherein said transmitter transmits a signal along a defined section of roadway, and wherein said defined section of roadway has a speed limit;

remotely transmitting a signal to said transmitter from a satellite, wherein said signal is interpreted by said transmitter to define said speed limit for said defined section of roadway;

transmitting a signal by said transmitter to said receiver;

causing said receiver in the vehicle to receive said signal from said transmitter, wherein said signal is interpreted by said receiver and said receiver provides information in the vehicle regarding said speed limit; and subsequently transmitting a signal communicating a revised speed limit that differs from said speed limit for said defined section of roadway to said transmitter.

13. The method of communicating information regarding speed limits as set forth in claim 12, comprising the additional steps of:

providing a receiver in a second vehicle, said receiver in said second vehicle having a visual display and audio output, and causing said receiver in said second vehicle to receive said signal from said transmitter, wherein said signal is interpreted by said receiver and said receiver visually displays information regarding said revised speed limit and said receiver outputs audio information regarding said revised speed limit.

14. The method of communicating information regarding speed limits as set forth in claim 12, wherein said signal transmitted by said transmitter to said receiver is interpreted by said receiver and said receiver outputs roadway condition information for said defined section of roadway in addition to the receiver outputting the speed limit for said defined section of roadway.

15. The method of communicating information regarding speed limits as set forth in claim 12, comprising the additional steps of said receiver determining an approach to a speed zone of said defined section of roadway and said receiver providing a first output at a first distance from said speed zone and providing a second output at a second distance from said speed zone.

16. The method of communicating information regarding speed limits as set forth in claim 12, comprising the additional steps of said receiver determining an approach to a speed zone of said defined section of roadway and said receiver providing a first visual output at a first distance from said speed zone and providing a second visual output at a second distance from said speed zone.

17. The method of communicating information regarding speed limits as set forth in claim 12, comprising the additional steps of said receiver controlling and limiting a maximum speed of said vehicle if said vehicle exceeds a plurality of speed limits as interpreted by said receiver from a plurality of signals received from a plurality of transmitters within a defined time period.

18. A method of communicating information regarding speed limits, comprising the steps of:

providing a receiver in a vehicle;

positioning a transmitter along a roadway, wherein said transmitter transmits a signal along a defined section of roadway, and wherein said defined section of roadway has a speed limit;

remotely transmitting a signal to said transmitter from a satellite, wherein said signal is interpreted by said transmitter to define said speed limit for said defined section of roadway;

transmitting a signal by said transmitter to said receiver;

causing said receiver in the vehicle to receive said signal from said transmitter, wherein said signal is interpreted by said receiver and said receiver provides information in the vehicle regarding said speed limit; and controlling and limiting a maximum speed of said vehicle if said vehicle exceeds a plurality of speed limits as interpreted by said receiver from a plurality of signals received from a plurality of transmitters within a defined time period.

19. The method of communicating information regarding speed limits as set forth in claim 18, wherein said signal transmitted by said transmitter to said receiver is interpreted by said receiver and said receiver outputs roadway condition information for said defined section of roadway in addition to the receiver outputting the speed limit for said defined section of roadway.

20. The method of communicating information regarding speed limits as set forth in claim 18, comprising the additional steps of said receiver determining an approach to a speed zone of said defined section of roadway and said receiver providing a first output at a first distance from said speed zone and providing a second output at a second distance from said speed zone.

* * * * *